US011193258B2

(12) United States Patent
Harrison et al.

(10) Patent No.: US 11,193,258 B2
(45) Date of Patent: Dec. 7, 2021

(54) FORCE ASSISTED ARTICULATING FAUCET

(71) Applicant: Kohler Co., Kohler, WI (US)

(72) Inventors: Matthew T. Harrison, Sheboygan, WI (US); Brad R. Hadfield, Port Washington, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 16/776,133

(22) Filed: Jan. 29, 2020

(65) Prior Publication Data

US 2020/0240125 A1 Jul. 30, 2020

Related U.S. Application Data

(60) Provisional application No. 62/798,717, filed on Jan. 30, 2019.

(51) Int. Cl.
*E03C 1/04* (2006.01)

(52) U.S. Cl.
CPC .... *E03C 1/0404* (2013.01); *E03C 2001/0414* (2013.01); *E03C 2001/0415* (2013.01); *Y10T 137/9464* (2015.04)

(58) Field of Classification Search
USPC ..... 137/801
See application file for complete search history.

(56) References Cited

U.S. PATENT DOCUMENTS

| | | | |
|---|---|---|---|
| 980,353 | A | 10/1911 | Smith |
| 2,492,049 | A | 12/1949 | Krone et al. |
| 2,857,201 | A | 10/1958 | Palmer |
| 3,451,628 | A | 6/1969 | Kelley |
| 4,709,715 | A | 12/1987 | Knight |
| 5,492,148 | A | 2/1996 | Goughneour et al. |
| 7,296,758 | B2 | 11/2007 | Zhou |
| D565,705 | S | 4/2008 | Kuran et al. |
| 8,070,076 | B2 | 12/2011 | Erickson et al. |
| 8,621,681 | B2 | 1/2014 | Macan et al. |
| 9,568,132 | B2 | 2/2017 | Erickson et al. |
| 9,850,642 | B2 | 12/2017 | Enlow et al. |
| 2007/0251590 | A1 | 11/2007 | Weinstein |
| 2009/0120516 | A1 * | 5/2009 | Paini ..... E03C 1/0404 137/605 |

FOREIGN PATENT DOCUMENTS

| | | |
|---|---|---|
| CN | 2795598 | 7/2006 |

* cited by examiner

*Primary Examiner* — Daphne M Barry
(74) *Attorney, Agent, or Firm* — Foley & Lardner LLP

(57) ABSTRACT

A faucet that includes a base; a riser having a first end, which couples to the base, and a distal second end; a first pivot member extending between first and second ends, wherein the first pivot member operatively couples to the second end of the riser at a first pivot axis located between the first and second ends of the first pivot member; a spout fluidly connected to the base through the riser and the first pivot member, the spout comprising an inlet end, which couples to the second end of the first pivot member such that the spout is rotatable relative to the riser through the first pivot member; and a biasing member operatively coupled to the first end of the first pivot member such that the biasing member creates a force, which biases and/or dampens relative rotation between the spout and the riser about the first pivot axis.

20 Claims, 14 Drawing Sheets

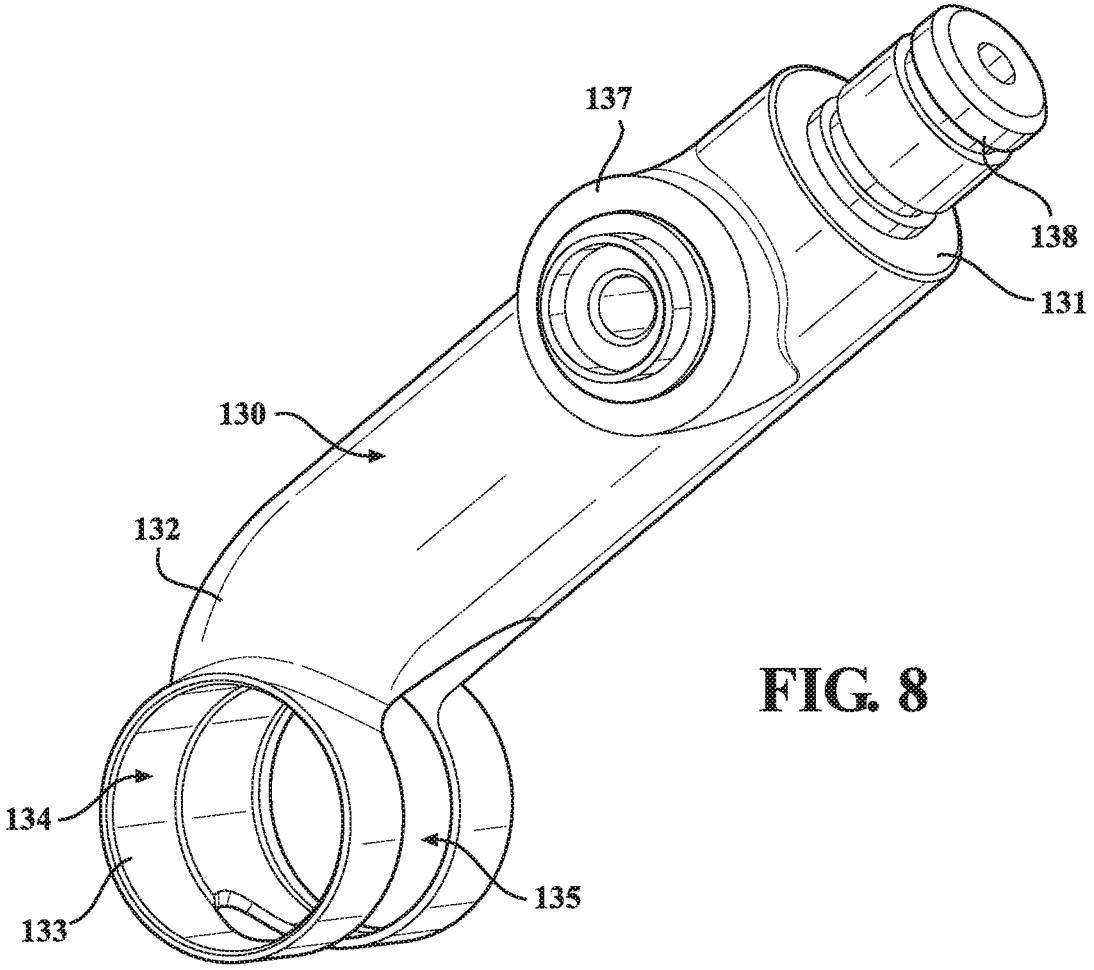
FIG. 8
FIG. 9
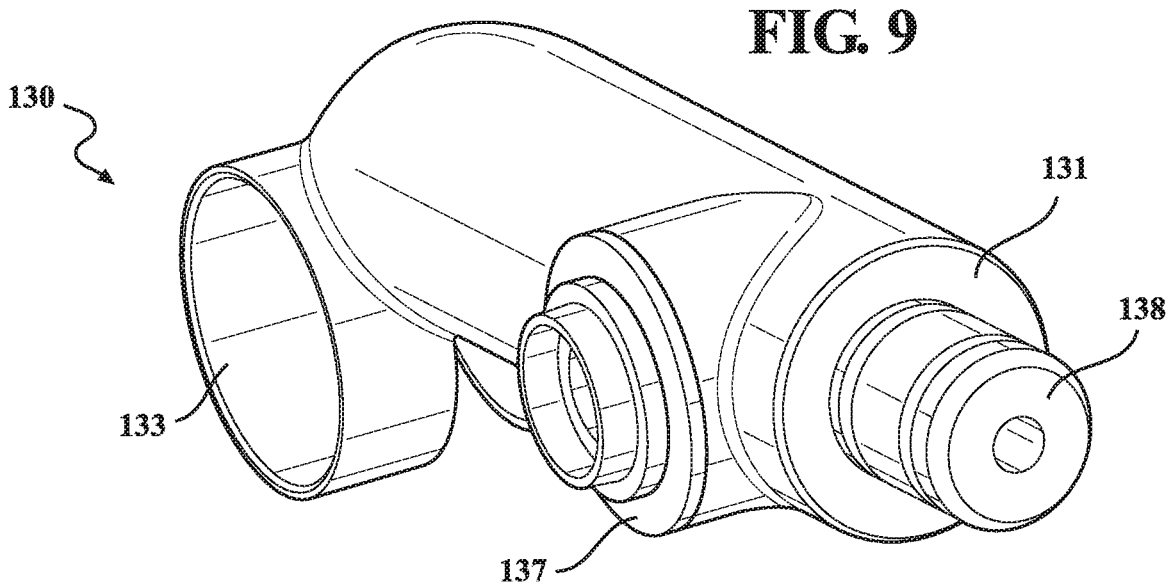

FORCE ASSISTED ARTICULATING FAUCET

CROSS-REFERENCE TO RELATED PATENT APPLICATIONS

This application claims priority to and the benefit of U.S. Provisional Application No. 62/798,717, filed Jan. 30, 2019, and incorporated herein by reference in its entirety.

BACKGROUND

The present application relates generally to the field of faucets. More specifically, this application relates to force (e.g., spring, piston) assisted articulating faucets that allow for repositioning of a spray head relative to a base.

SUMMARY

At least one embodiment of the application relates to a faucet that includes a base, a riser, a pivot member, a spout, and a biasing member. The base is configured to mount to a support. The riser has a first end, which couples to the base, and a distal second end. The pivot member can be a first pivot member that extends between a first end and a second end, wherein the first pivot member operatively couples to the second end of the riser at a first pivot axis located between the first and second ends of the first pivot member. The spout fluidly connects to the base through the riser and the first pivot member, the spout comprising an inlet end, which couples to the second end of the first pivot member such that the spout is rotatable relative to the riser through the first pivot member. The biasing member operatively couples to the first end of the first pivot member such that the biasing member creates a force, which biases and/or dampens relative rotation between the spout and the riser about the first pivot axis.

At least one embodiment of the application relates to a faucet that includes a riser, at least one pivot member, a spout, and a biasing member. The at least one pivot member can include a first pivot member, a second pivot member, and a third pivot member. The riser has a first end and a distal second end. The first pivot member extends between a first end and a second end, wherein the first pivot member operatively couples to the second end of the riser at a first pivot axis located between the first and second ends of the first pivot member. The spout has an inlet end, which couples to the second end of the first pivot member to fluidly connect the spout to the riser through the first pivot member. The second pivot member defines a second pivot axis and is operatively coupled to a portion of the riser located between the first and second ends thereof. The third pivot member defines a third pivot axis and is operatively coupled to the first end of the first pivot member. The biasing member pivotally couples to each of the second and third pivot members about the second and third pivot axes, respectively, such that the biasing member creates a force, which biases and/or dampens relative rotation between the spout and the riser about the first pivot axis.

At least one embodiment of the application relates to a faucet that includes a riser; a spout; first, second, and third pivot members; and a biasing member. The riser has upper and lower ends. The first pivot member has a body, which extends between first and second ends, and a projection, which is located between the first and second ends and which pivotally couples the first pivot member to the upper end of the riser. The spout couples to the second end of the first pivot member to fluidly connect the spout to the riser through the first pivot member. The second pivot member operatively couples to a portion of the riser, which is located between the upper and lower ends. The third pivot member operatively couples to the first pivot member. The biasing member includes first and second portions. The first portion pivotally couples to the second pivot member; and the second portion operatively couples to the first portion and pivotally coupled to the third pivot member. The biasing member creates a force, which biases and/or dampens relative rotation between the spout and the riser.

BRIEF DESCRIPTION OF THE DRAWINGS

The disclosure will become more fully understood from the following detailed description, taken in conjunction with the accompanying figures, wherein like reference numerals refer to like elements, in which:

FIG. 8 is a perspective view of a portion of the faucet.

FIG. 9 is another perspective view of the portion of the faucet shown in FIG. 8.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the FIGURES, disclosed herein are force (e.g., spring-damper) assisted articulating faucets that allow a user the ability to extend the reach and reposition the spray head (and hence the flow of water from the spray head of the faucet). The faucets allow the user to use and the release their faucet, where upon release the faucet gently returns to the home position. For example, the faucets can provide this controlled movement through the use of a biasing member, such as a spring-damper system that includes a spring-damper that provides a biasing force and/or a damping force, such as to provide a "slow-return"

(e.g., slow-close, gentle-return, etc.). The spring-damper can include, for example, a shock absorber, a gas piston or strut, a mechanical strut, and/or a spring. Some articulating type (e.g., pull-out, pull-down, pro-style, pot-fill) faucets are configured such that the user must return the faucet to the home position. Some (e.g., pro-style) faucets rely on the resistance of a hose and/or a coil spring externally wound around the hose to return or dock the spray head. However, the return on such faucets can be abrupt and aggressive, which can lead to customer complaints.

Figure 1:
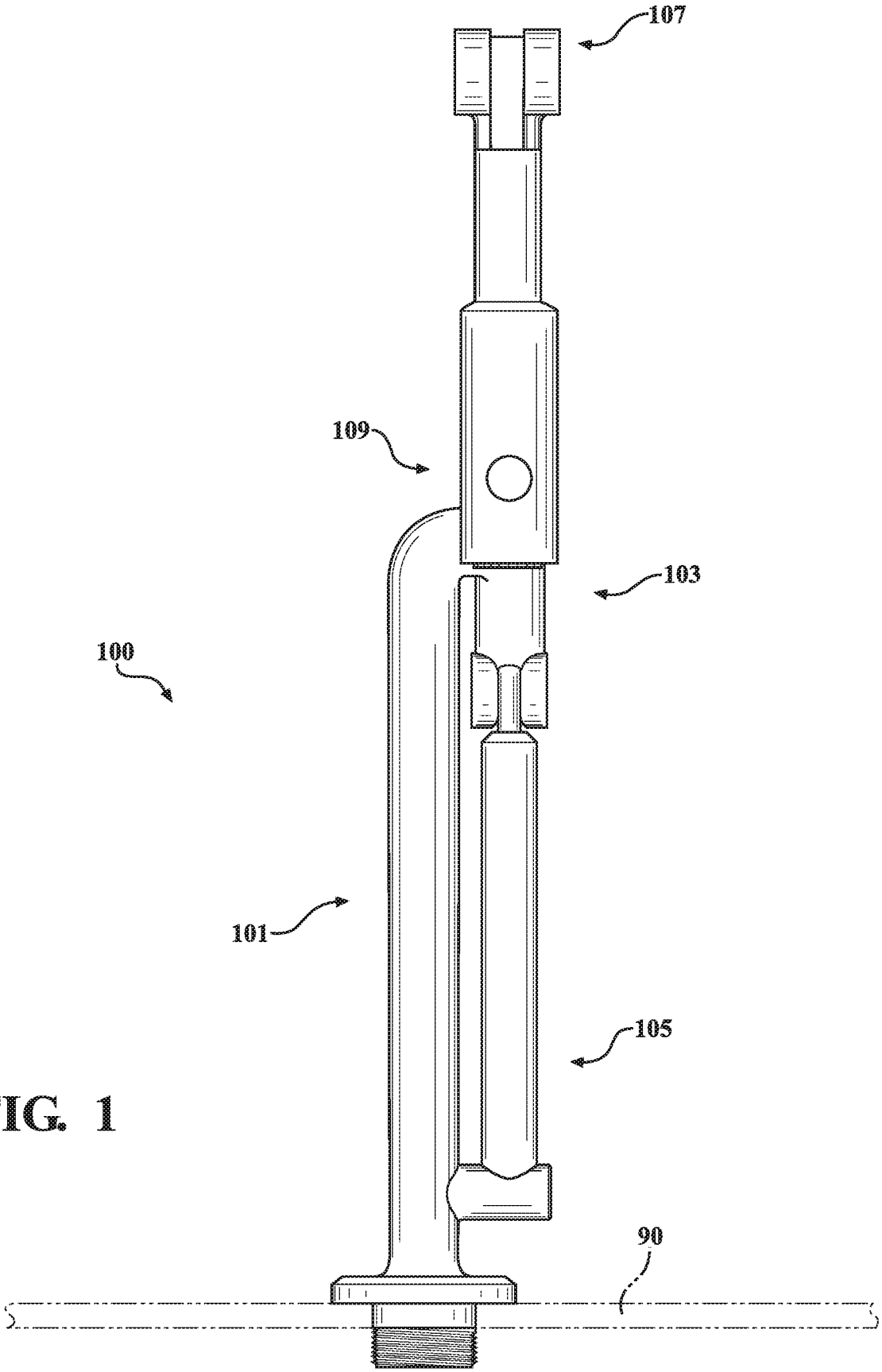
FIG. 1 is a front view of an embodiment of a faucet, according to this application.
Figure 2:
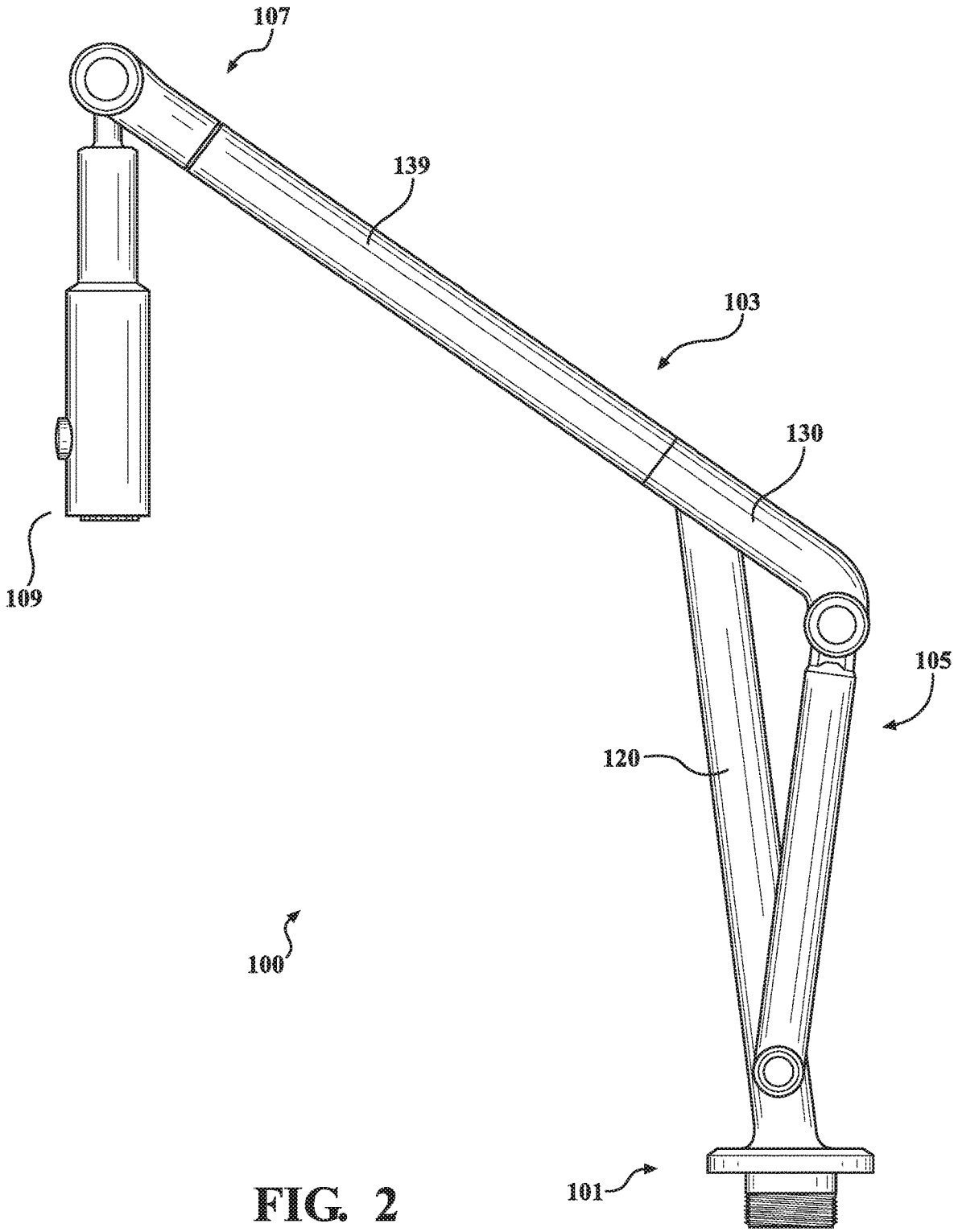
FIG. 2 is a side view of the faucet.

FIGS. 1 and 2 illustrate a faucet 100 that includes a base or base assembly 101, an arm or arm assembly 103, a biasing member 105, a sprayer pivot assembly 107, and a sprayer assembly 109. The biasing member 105 or biasing assembly can be in the form of a piston or strut assembly (e.g., including a hydraulic or pneumatic piston/strut), a spring assembly (e.g., including a compression spring, coil spring, or any suitable type of spring), a combination thereof, or another suitable type of member/assembly, such as those discussed herein or otherwise, that is capable of applying a force (e.g., biasing force) upon relative motion (e.g., rotation). The base assembly 101 is mountable to a deck, counter, or other similar support, which is generally shown in FIG. 1 as support 90. The arm assembly 103 is rotatable relative to the base assembly 101 to change the position of the sprayer assembly 109 for customer convenience, during which movement the biasing member 105 provides resistance to the movement and/or biases the sprayer assembly 109 back to a "home" position, such as the position shown in FIGS. 1 and 2.

Figure 5:
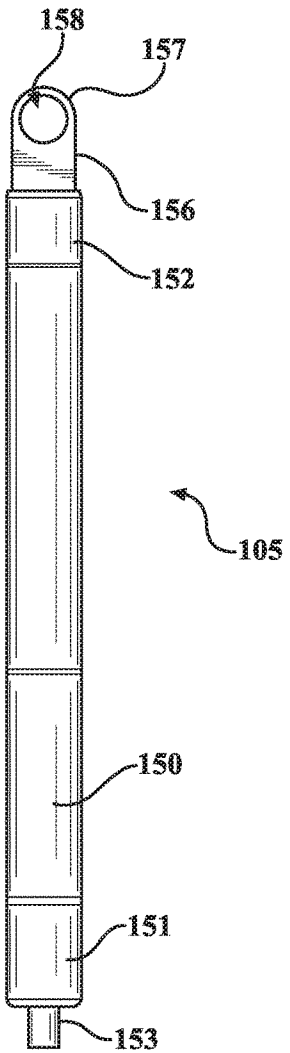
FIG. 5 is a plan view of a piston assembly of the faucet.

The biasing member 105 shown in FIG. 5 includes an outer body 150 and an inner body 156 that extends into the outer body 150. An internal biasing system, which can include a fluid (e.g., hydraulic, pneumatic) piston, a spring, or another biasing device applies a force, which biases and/or dampens relative movement between the inner and outer bodies 156, 150. The illustrated outer body 150 includes a first end 151, which is closed, and a second end 152, which is open to receive the inner body 156. A threaded post 153 extends from the first end 151, such as to couple the biasing member 105 to the base assembly 101, as discussed below. The inner body 156 includes a first end 157 that is located outside of the outer body 150 and a second end (not shown) provided inside the outer body 150. The illustrated first end 157 includes a mounting hole 158 (e.g., an opening, a bore, etc.) for coupling the biasing member 105 to the arm assembly 103, as discussed below. An intermediate member 154 may be positioned between the threaded post 153 and the first end 151 with one or more O-rings 155 sealing between the intermediate member 154 and the threaded post 153 and/or the first end 151 (see FIG. 7).

Figure 4:
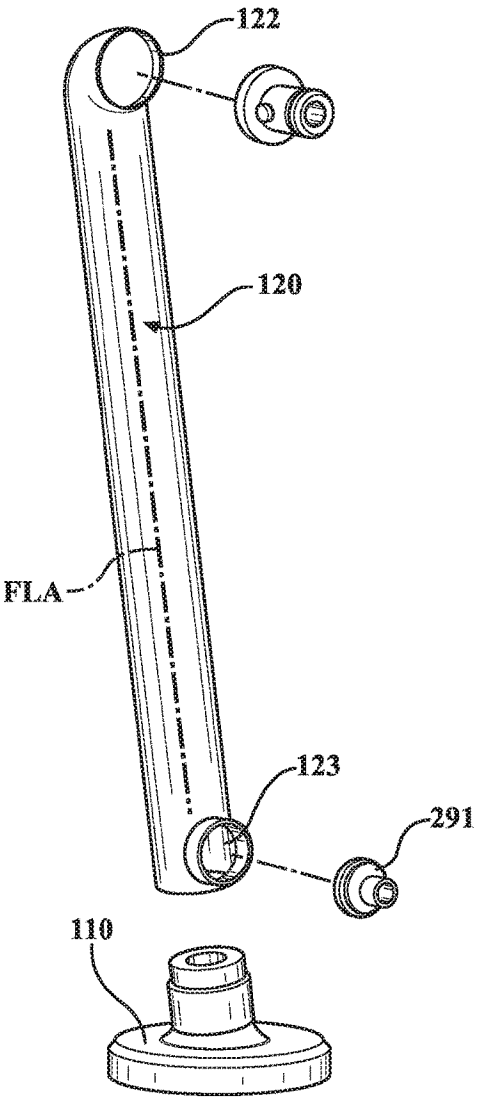
FIG. 4 is an exploded view of a portion of the base assembly shown in FIG. 3.
Figure 3:
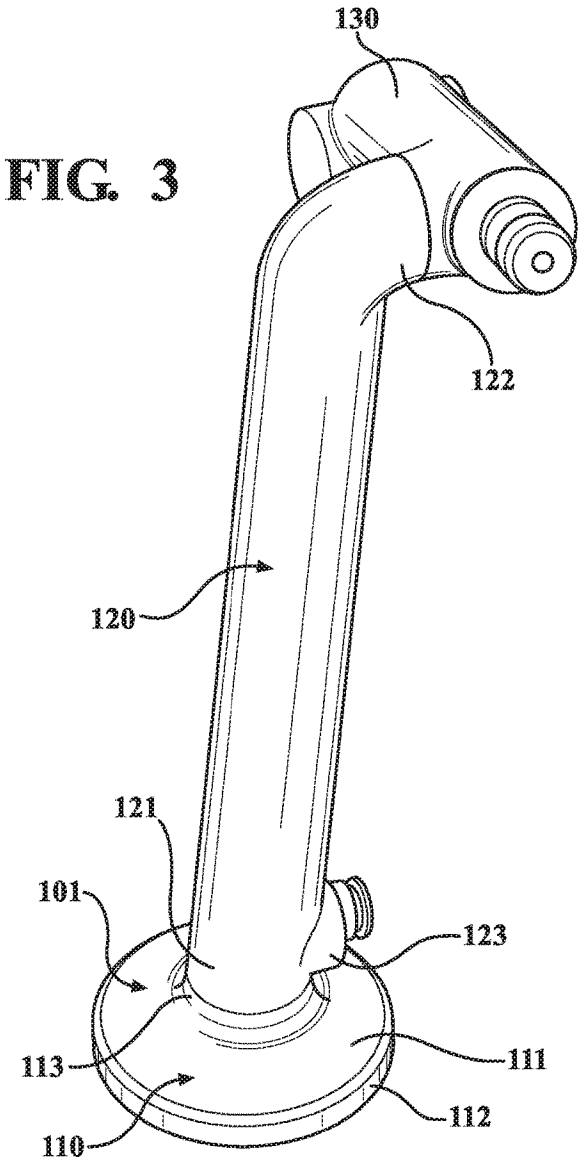
FIG. 3 is a perspective view of a base assembly of the faucet.
Figure 6:
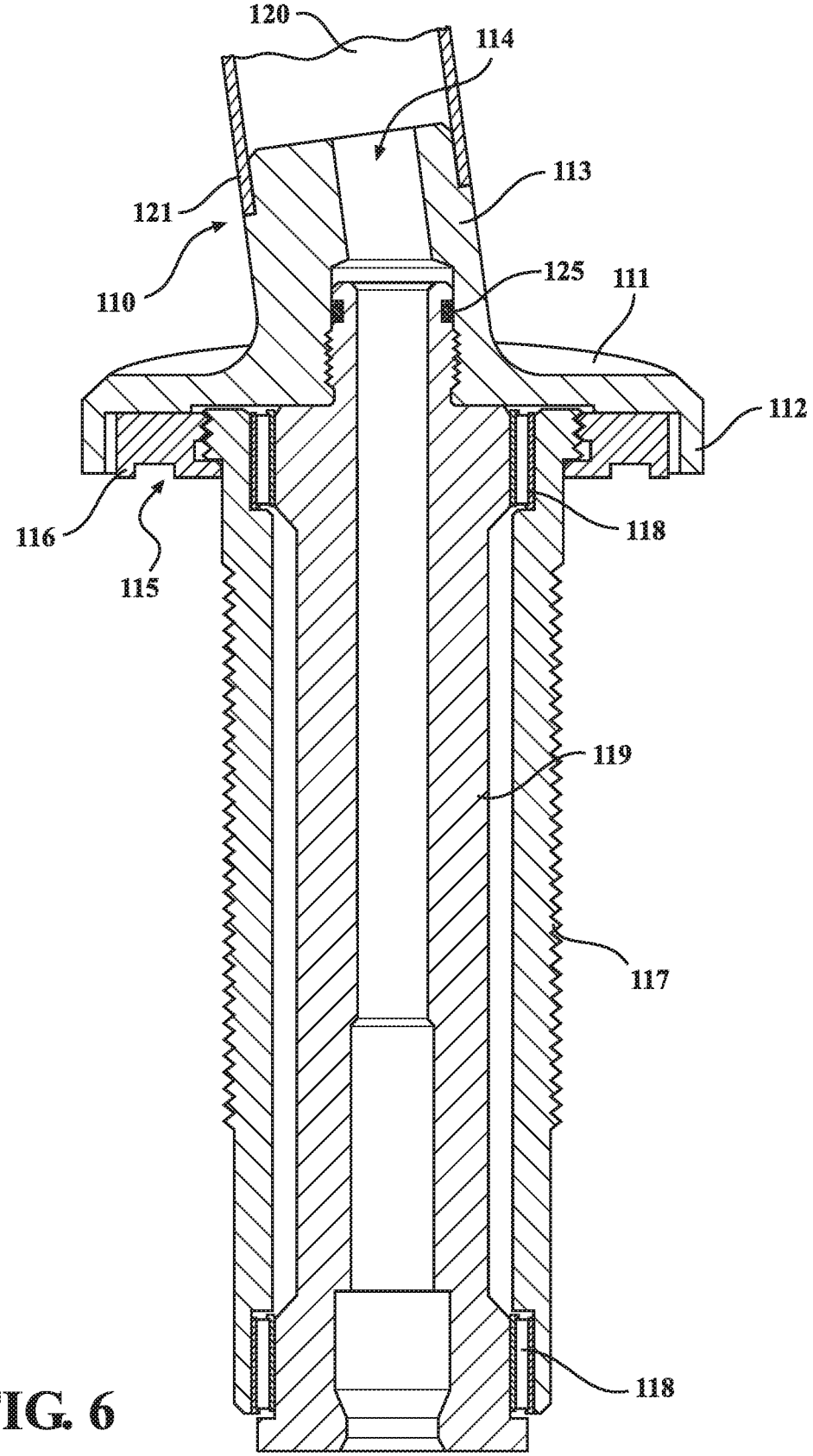
FIG. 6 is a cross-sectional view of a portion of the base assembly.

As shown in FIGS. 3 and 4, the base assembly 101 includes a base 110 having an annular plate 111, a downwardly projecting annular flange 112 at the outer periphery of the plate 111, and an upwardly projecting annular shoulder 113. As shown in FIG. 6, a bore 114 extends through the shoulder 113 and the plate 111, and the flange 112 defines a pocket 115. The bore 114 can be counterbore, as shown, having a first diameter (e.g., upper) portion and a second diameter (e.g., lower) portion, which is larger than the first diameter portion.

The base assembly 101 can be mounted to a support (e.g., deck, counter, etc.) through a bearing assembly. FIG. 6 shows an example of a bearing assembly that includes a collar 116, a threaded sleeve 117, a bearing 118, and a waterway 119. The illustrated collar 116 has an annular shape with a central opening through which the threaded sleeve 117 is positioned. The sleeve 117 includes a cylindrical portion having external threads, such as to receive a nut or other fastener to clamp the bearing assembly to the support, and an annular end portion that extends radially outward from the cylindrical portion and has external threads that thread to internal threads of the collar 116. The end portion of the sleeve 117 is shown to rest on a flange of the collar 116 that extends radially inward below the threads of the collar 116. The waterway 119 is configured to direct water from a valve and/or water source to the faucet 100. The waterway 119 has a generally cylindrical body extending between a first or upper end and a second or lower end. Disposed proximate each end of the waterway 119 is a shoulder that extends radially outward. As shown in FIG. 6 a (first) bearing 118 is disposed between the upper shoulder of the waterway 119 and the sleeve 117, and a (second) bearing 118 is disposed between the lower shoulder of the waterway 119 and the sleeve 117 to allow the waterway 119 to rotate relative to the sleeve 117. The sleeve 117 can include an annular recess that receives each bearing 118. Protruding upwardly from the upper end of the waterway 119 is a longitudinal shoulder that is coupled to the base 110, such as by threading external threads of the longitudinal shoulder of the sleeve 117 to internal threads defining the lower portion of the bore 114 of the base 110. Thus, the bore 114 receives the longitudinal shoulder. An O-ring 125 can be positioned above the threads to seal between the waterway 119 (e.g., the longitudinal shoulder) and the base 110 (e.g., the shoulder 113).

During installation of the faucet 100 to a support (e.g., the support 90), the sleeve 117 is inserted into the central opening in the collar 116 and then threaded to the collar 116 to couple the sleeve 117 and collar 116 together. The collar 116 is configured to rest on (i.e., be supported by) the support on which the faucet 100 is mounted. The waterway 119 is inserted into a central bore of the sleeve 117 with the bearings 118 in place rotatably coupling the waterway 119 and sleeve 117, as described above. The base 110 is threaded to the longitudinal shoulder of the waterway 119 with the bore 114 of the base 110 being fluidly connected to a fluid passage extending through the waterway 119 and with the O-ring 125 providing a seal between the base 110 and the waterway 119. The sleeve 117 can be secured to the support by threading a nut (or other fastening element) over the external threads of the sleeve 117 to clamp the support between the nut and the collar 116. In this way, the base 110 and the waterway 119 are rotatable relative to the collar 116 and the sleeve 117 thereby allowing rotation of the faucet (e.g., sprayer, arm, etc.) relative to the support.

The illustrated base assembly 101 also includes a tubular riser 120. As shown best in FIG. 4, the tubular riser 120 extends along a first longitudinal axis FLA from a first (e.g., lower) end 121 toward a second (e.g., upper) end 122. The first end 121 includes an opening that is in line with the first longitudinal axis FLA and is receives the shoulder 113 of the base 110, as shown in FIG. 6. The opening in the first end 121 can be a counterbore, such that an end surface of the first end 121 contacts an end of a larger diameter portion of the shoulder 113 and a smaller diameter portion of the shoulder 113 extends into the first end 121. The second end 122 includes an elbow section that turns an angle (e.g., approximately 90° or orthogonally) to the first longitudinal axis FLA, such that an opening in the second end 122 is transverse to the opening in the first end 121 and the first longitudinal axis FLA. An annular projection 123 extends from the first end 121 in a radial direction relative to the first longitudinal axis FLA, such that an opening in the projection 123 is transverse to the opening in the first end 121. As shown, the radial direction of the projection 123 is parallel to the radial direction of the second end 122, although these directions are configurable differently than what is shown. The opening in the projection 123 can be planar or parallel to the opening in the second end 122. As discussed below, the arm assembly 103 is pivotally coupled to the second end 122, and the biasing member 105 is pivotally coupled to the projection 123 to provide the biased (e.g., spring assisted) articulation of the arm assembly 103 and sprayer of the faucet 100. The riser 120 is configured to fluidly connect the base 110 and the arm assembly 103, such as by an internal waterway, which can be defined by the inside of the riser 120 or can be a separate element that is disposed within the riser 120. A hose or other similar element can also be employed for fluid communication.

As shown in FIG. 2, the arm assembly 103 includes a pivot member 130 and a spout 139 coupled to the pivot member 130. The pivot member 130 is pivotally coupled to the second end 122 of the riser 120 at a first pivot axis FPA (see FIG. 12) and is pivotally coupled to the biasing member 105 at a second pivot axis SPA (see FIG. 10). The pivot member 130 is shown in FIGS. 8 and 9 as generally tubular extending from a first end 131 to a second end 132. Disposed on the second end 132 is an annular pivot sleeve 133 having a lateral bore 134 and a semi-circumferential slot 135 extending through a central portion. The pivot member 130 includes an annular projection 137 extending laterally from a side at a location between the first and second ends 131, 132, where the projection 137 is configured to pivotally couple the pivot member 130 to the second end 122 of the riser 120 through a pivot assembly. A post 138 extends from the first end 131 and is configured to operably couple to the spout 139. For example, the post 138 can thread to threads in the spout 139. Also, for example, the post 138 can include shoulders, as shown in FIGS. 8 and 9, that define one or more than one recess or channel, such as to receive a set screw, snap-ring, or other fastening element to secure the spout 139 to the pivot member 130.

Figure 11:
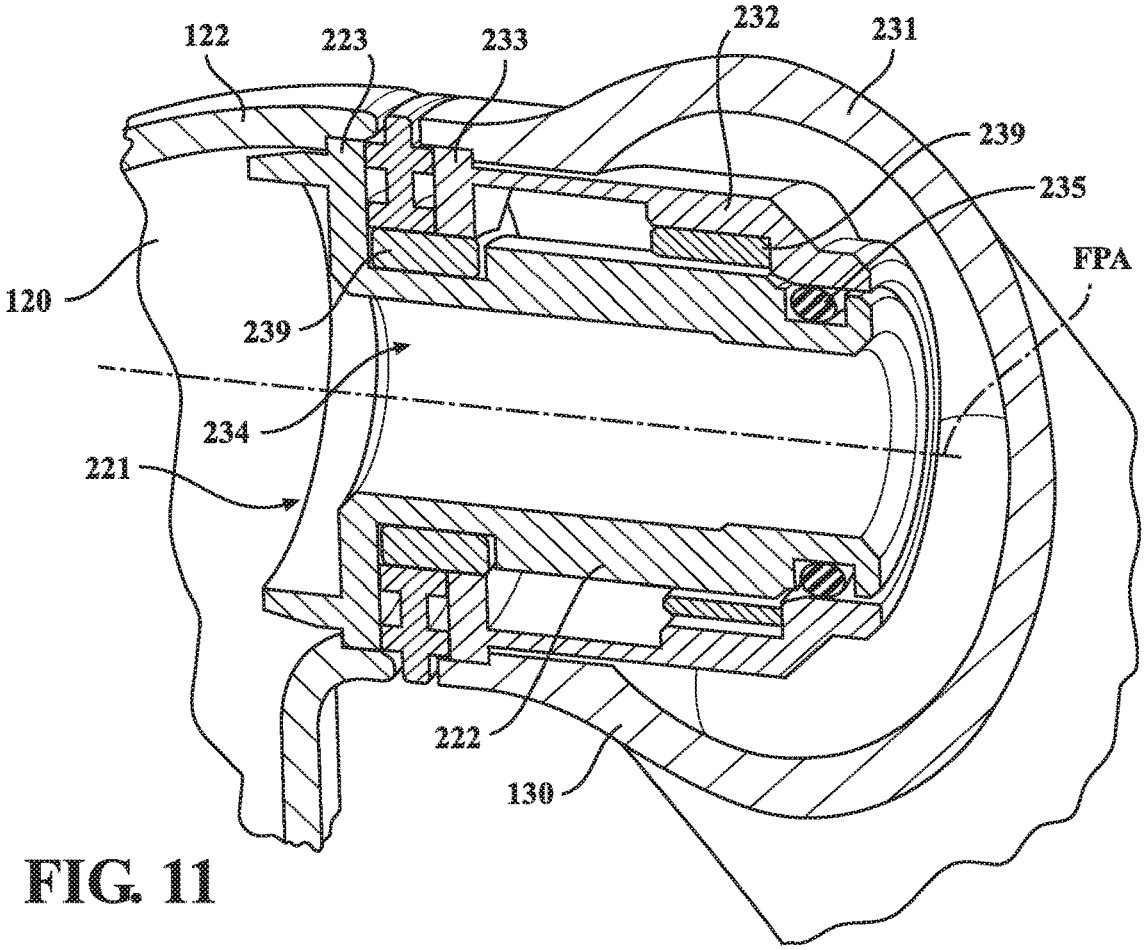
Figure 15:
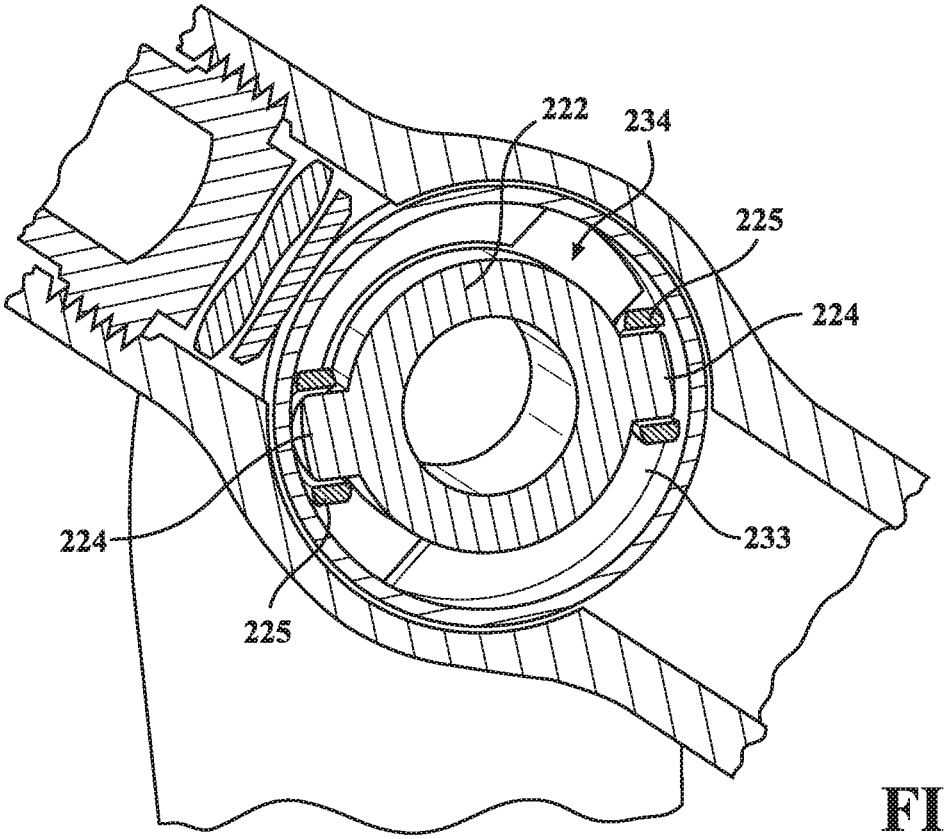
Figure 16:
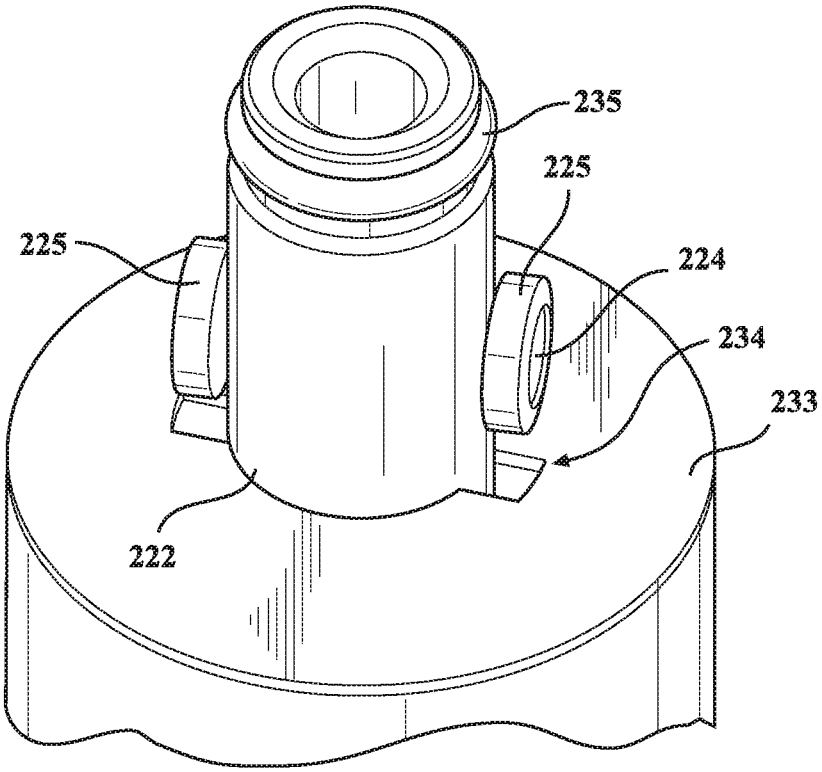
FIG. 16 is a perspective view of the pivot assembly shown in FIG. 15.

FIGS. 11, 15 and 16 illustrate an example of a bayonet style pivot assembly 220 that includes male and female connectors coupled to the riser 120 and the pivot member 130. The male connector 221 includes a hollow post 222, a flange 223, which extends radially outward from the post 222 and is coupled to the inside of the second end 122 of the riser 120, and a pair of pins 224 (FIG. 15), which extend radially outward from two opposite sides of the post 222. An annular cap 225, which can be a bushing, is shown disposed around each pin 224 in FIGS. 15 and 16. The female connector 231 includes a hollow cylindrical receptacle 232 having an end cap 233, which extends radially inward from the receptacle 232 and has an opening 234 that is shape to complement the male connector 221 (e.g., the post 222 and pins 224) such that the pins 224 can be inserted into the opening 234 and into the receptacle 232, whereon a relative predetermined rotation between the male and female connectors, the pins 224 are retained by the cap 233 to secure the connectors (along with the riser and the pivot member). The cap 233 can extend radially outward to couple to the projection 137 of the pivot member 130. An O-ring 235 is shown in FIG. 11 between and sealing the receptacle 232 and the post 222. One or more bushings 239 can be disposed between the receptacle 232 and the post 222 as shown in FIG. 11. Fluid can be routed from the riser 120 to the arm assembly 103 through the bore in the hollow post 222 either directly or through a fluid conduit (e.g., hose).

Figure 12:
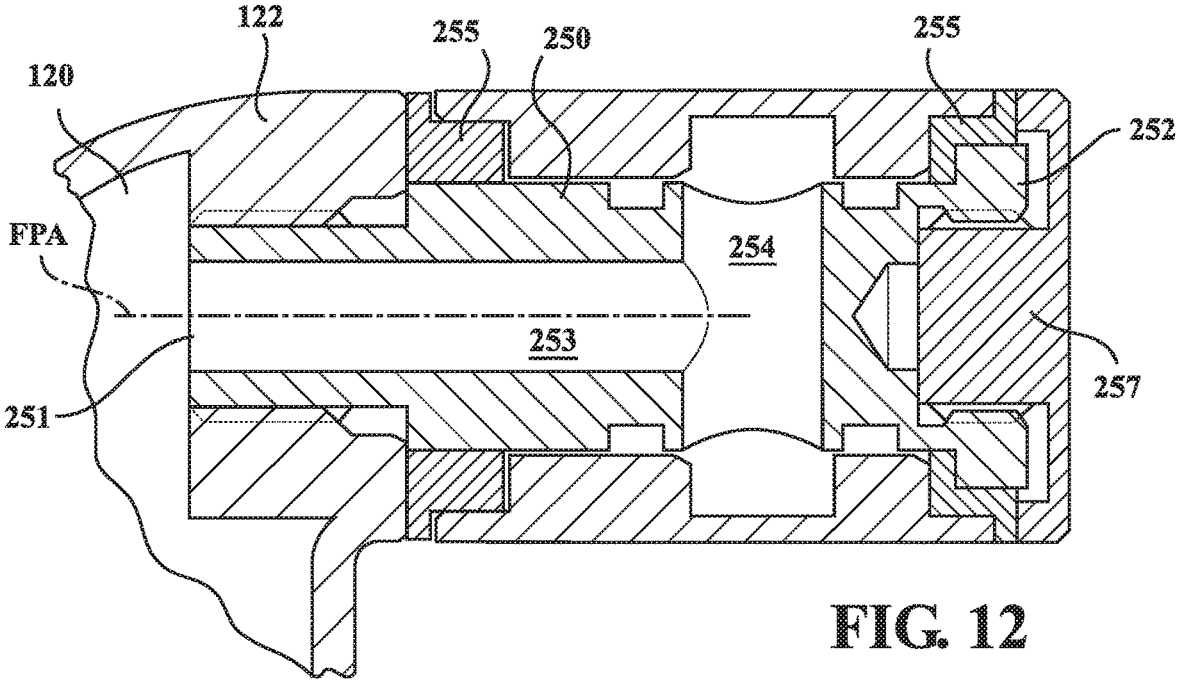

FIG. 12 illustrates an example of a threaded pivot assembly that includes a (first) fastener 250 having a first end 251, which threads to threads in the second end 122 of the riser 120, and a second end 252. A portion of the pivot member 130 is slid over the second end 252 of the fastener 250, with one or more bushings 255 disposed between the fastener 250 and the pivot member 130 and/or the riser 120. A (second) fastener 257 threads to the second end 252 of the fastener 250 to retain the pivot member 130 and bushing(s) 255 between the second end 122 and the fastener 257. The fastener 250 fluidly connects the riser 120 and the pivot member 130, such as through a T-shaped fluid passage including a horizontal passage 253 fluidly connected to the riser 120 and a vertical passage 254 fluidly connected to the pivot member 130.

Figure 13:
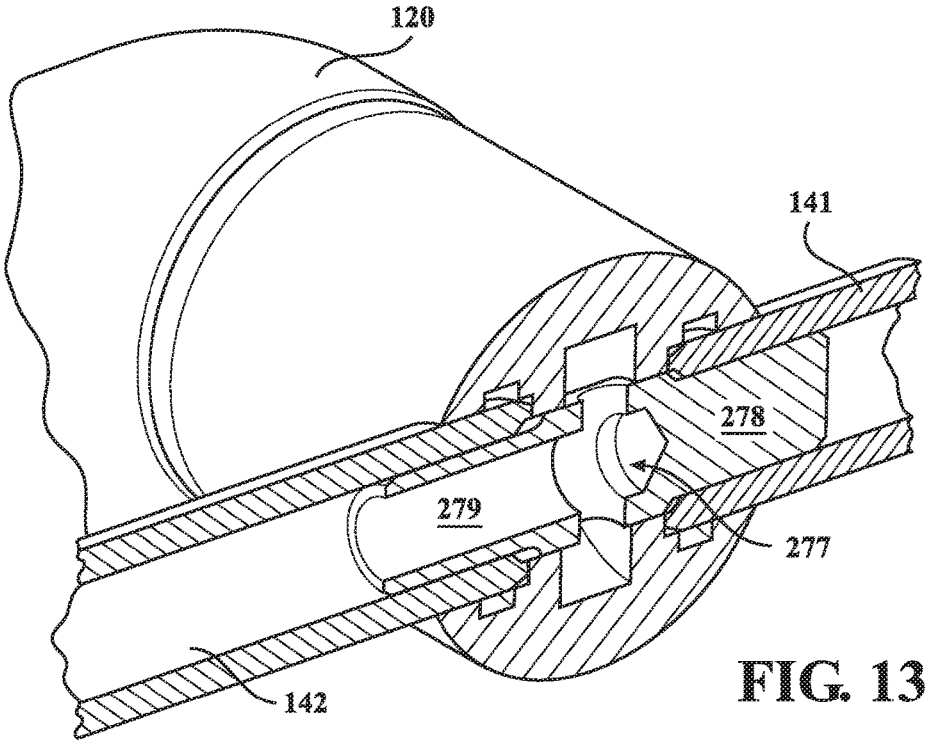
Figure 14:
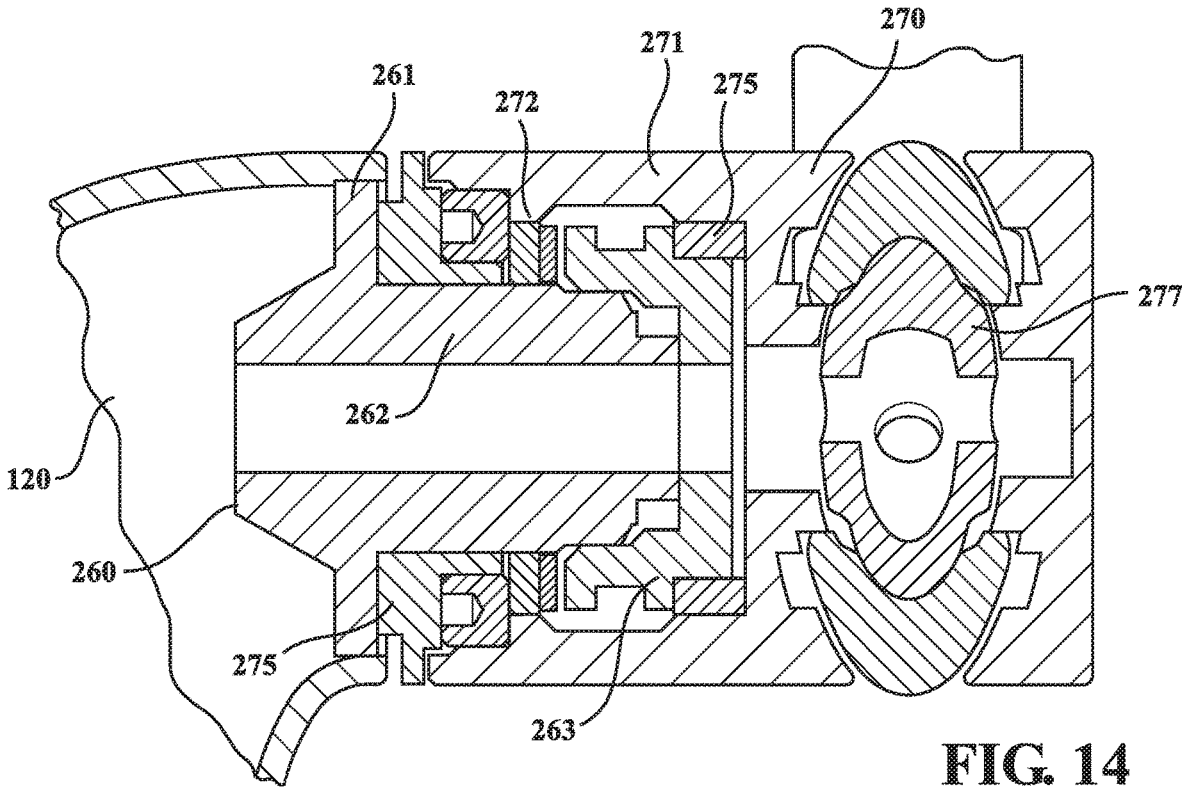

FIGS. 13 and 14 illustrate another example of a pivot assembly that includes male connector 260 coupled to the second end 122 of the riser 120 and a female connector 270. The male connector 260 includes a flange 261 that is coupled to the riser 120 and a hollow body 262 extending from the flange 261. An end member 263 can be integrally formed with the body 262 or formed separately and coupled thereto, such as through threads. The end member 263 can include a bayonet feature, such as described above, or another attachment feature for connecting the male connector 260 to the female connector 270, which includes an outer wall 271 defining an inner pocket for receiving the male connector 260. An inwardly protruding flange 272 can define an opening that receives the end member 263. One or more bushings 275 can be disposed between the male and female connectors 260, 270. For this example, the female connector 270 can be integrally formed with the pivot member 130 or formed separately and coupled thereto. A waterway 277 is disposed in the female connector 270 that is fluidly connected to the riser 120 through the male connector 260. As shown in FIG. 13, the waterway 277 includes a solid end 278 that is received in a first tubular extension 141, which can form part of the arm assembly 103, and a hollow end 279 that is received in and fluidly connected to a second tubular extension 142, which can form part of the arm assembly 103.

Figure 10:
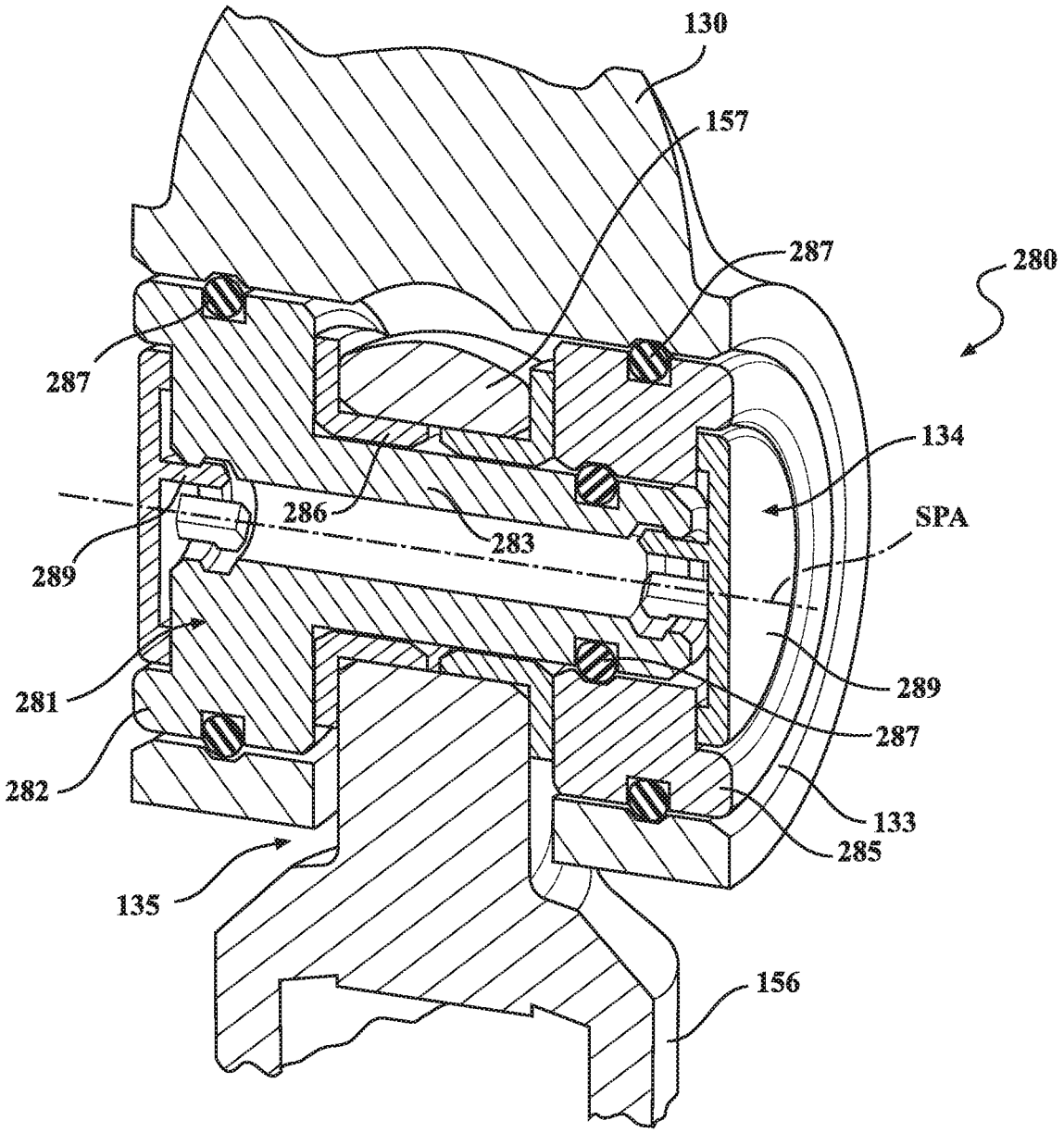
FIGS. 10-15 are cross-sectional views of various pivot assemblies for use in the faucet.

FIG. 10 shows that the pivot sleeve 133 receives a pivot assembly 280 in the bore 134 to pivotally couple the pivot member 130 and the biasing member 105. The pivot assembly 280 includes a male fastener 281 (e.g., bolt, post, etc.) having a head 282 and a shank 283, which extends away from the head 282 and engages the mounting hole 158 in the end 157 of the inner body 156 of the biasing member 105. A female fastener 285 (e.g., nut, collar, etc.) is coupled to a distal end of the shank 283 to retain the end 157 of the inner body 156 between the head 282 and the female fastener 285, with a bearing 286 disposed between the end 157 and the male and female fasteners 281, 285. The female fastener 285 can thread to the shank 283 or be coupled in other ways, such as using a snap ring or other similar fastener. As shown in FIG. 10, O-rings 287 are disposed between and/or couple each of the male and female fasteners 280, 285 to the sleeve 133 as well as the male and female fasteners together. The O-rings 287 act as relative low friction bearings. Also shown, the male fastener 281 includes a through bore allowing a snap-cover 289 to snap to the bore to cover each end of the pivot assembly 280.

Figure 7:
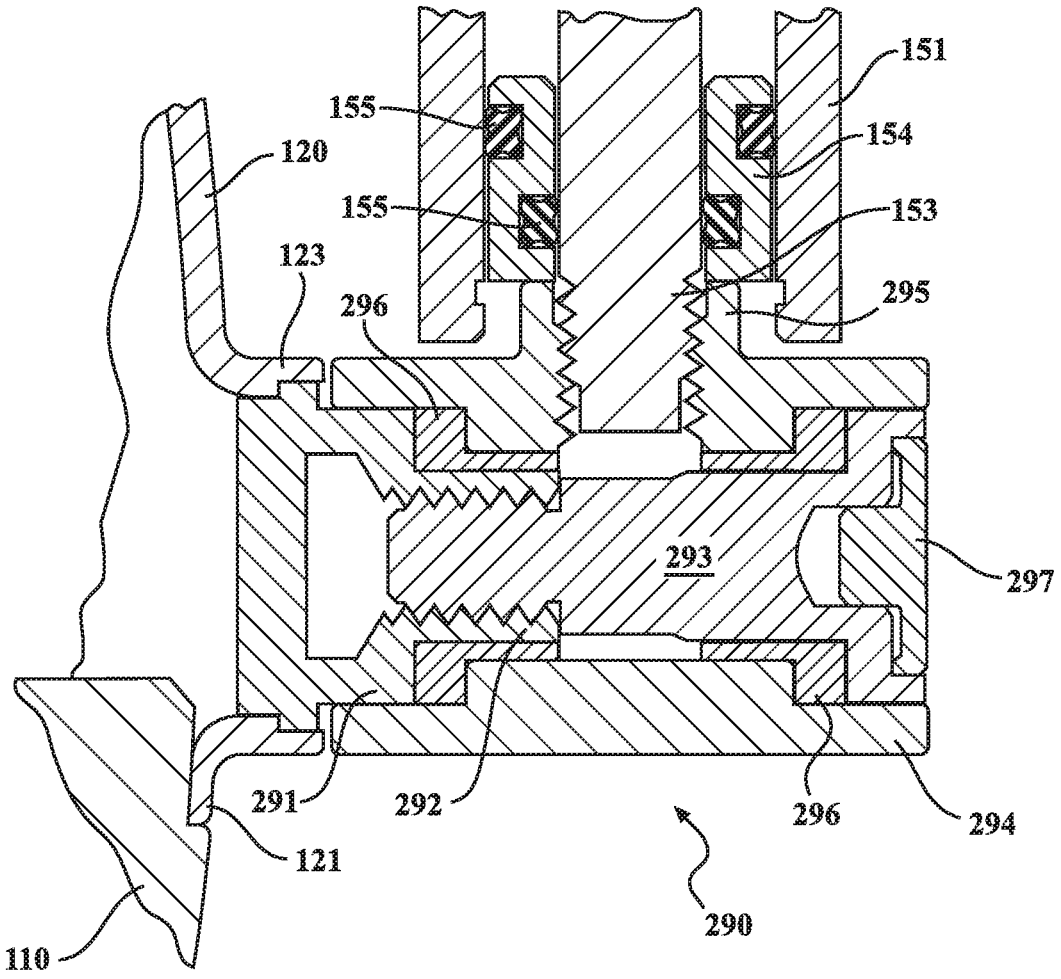
FIG. 7 is a cross-sectional view of a portion of a pivot assembly of the faucet.

FIG. 7 illustrates a pivot assembly 290 pivotally coupling the biasing member 105 to the projection 123 of the riser 120. The pivot assembly 290 includes a plug 291 that is coupled to the projection 123 and plugs the opening therein. A shoulder 292 extends from the plug 291 (away from the riser 120) and includes a threaded bore for receiving a threaded shank of a fastener 293, the head of which retains a collar 294 around the fastener 293 and the plug 291. Extending from a top side of the collar 294 is a projection 295 having a threaded bore, which receives the threaded post 153 to couple the biasing member 105 to the collar 294. The collar 294 is rotatable relative to the fastener 293 and the plug 291 via bearings 296 disposed between them. A cover 297 can be coupled (e.g., snapped) to the head of the fastener 293 to provide a clean, finished aesthetic.

Figure 18:
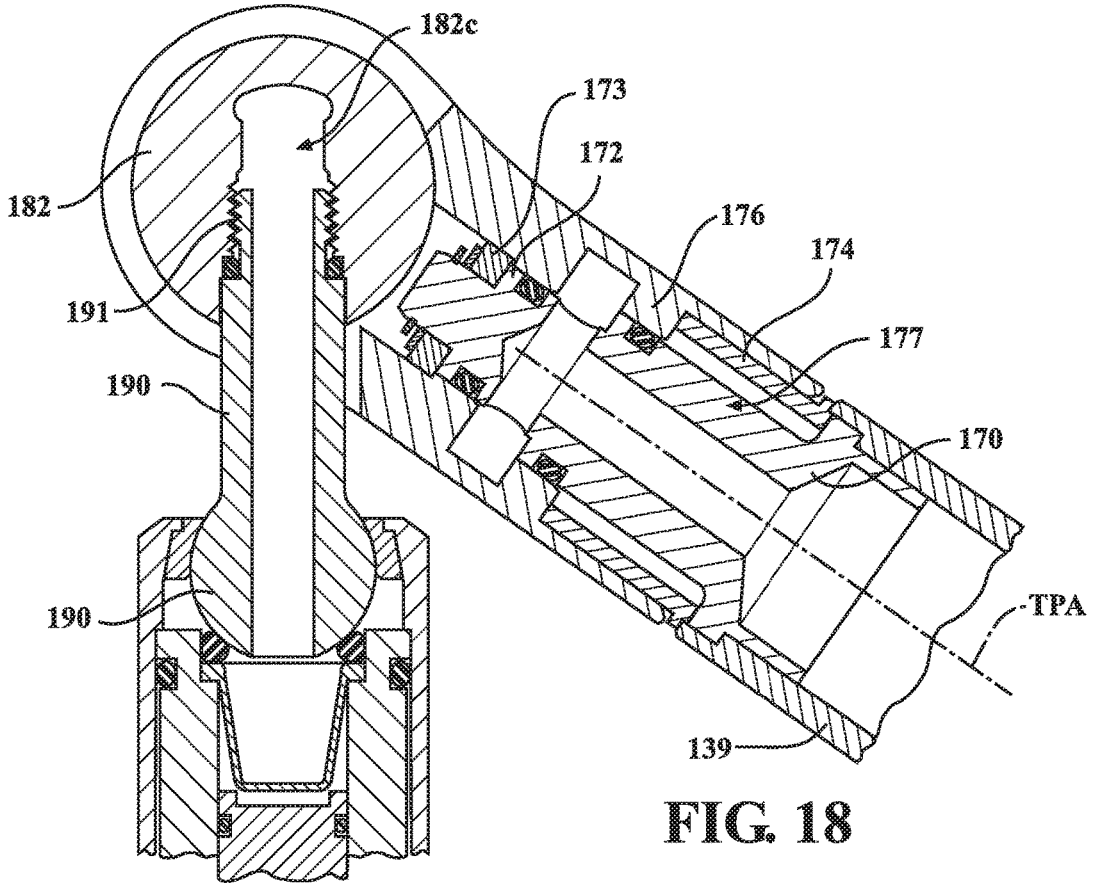
Figure 19:
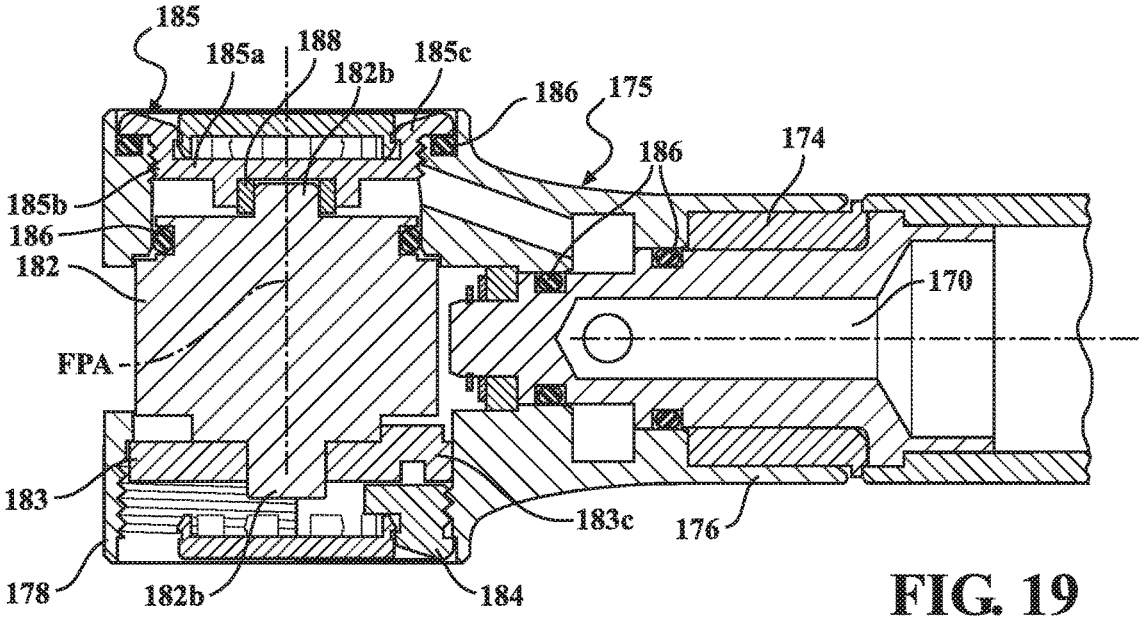
Figure 20:
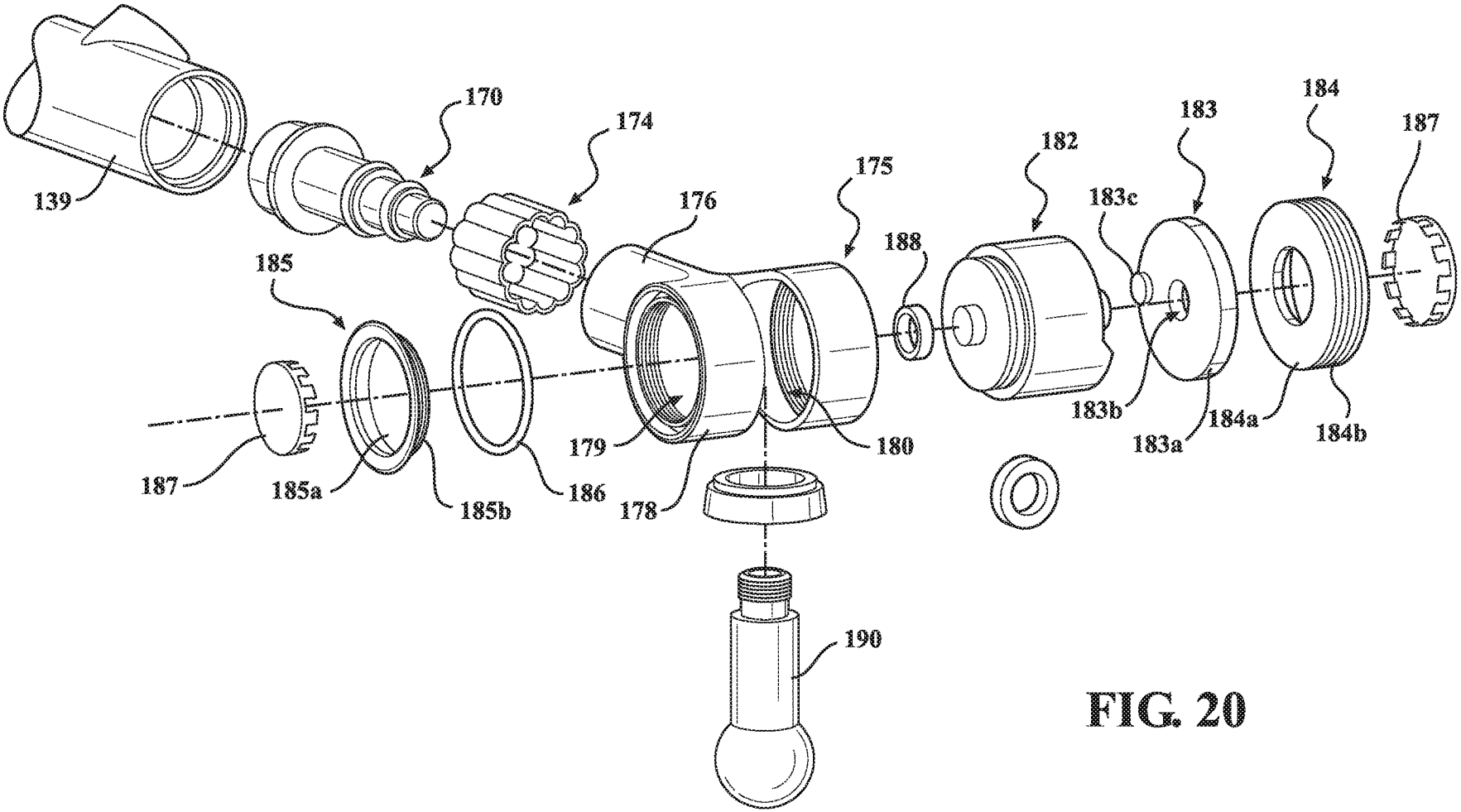
FIG. 20 is an exploded view of the sprayer pivot assembly.
Figure 22:
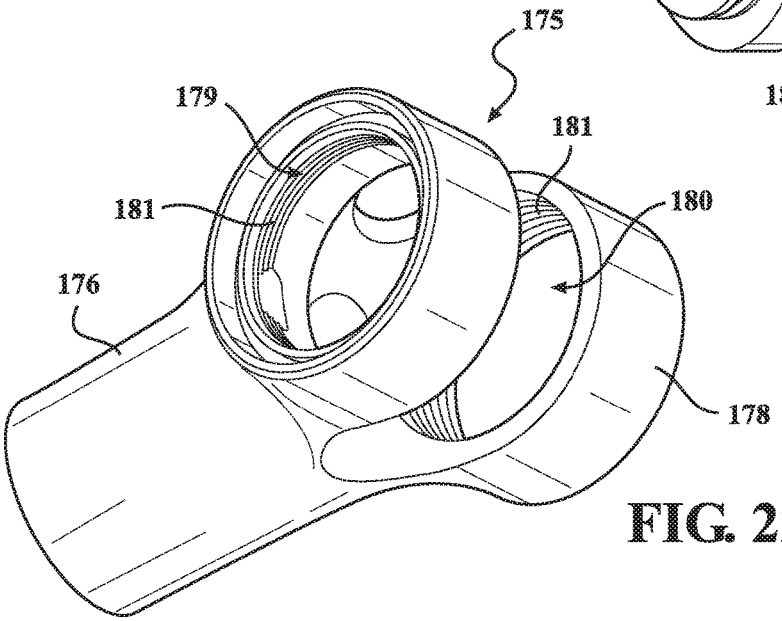
FIG. 22 is a perspective view of a knuckle of the sprayer pivot assembly.
Figure 23:
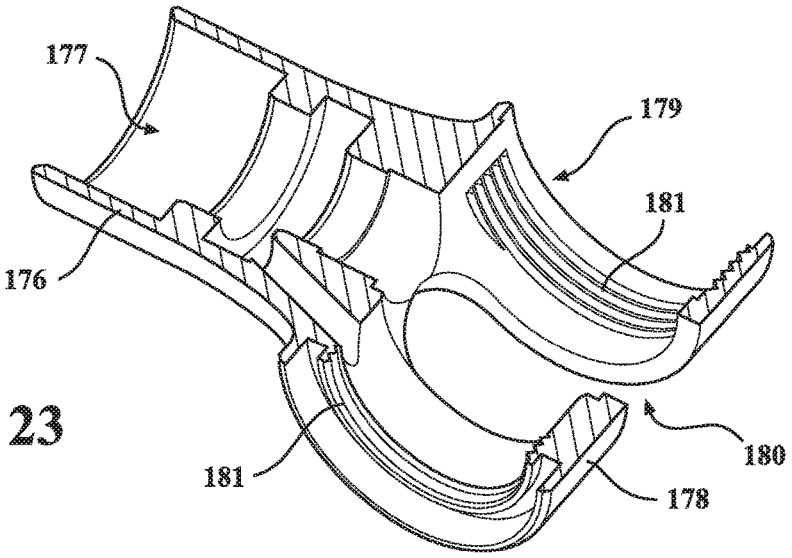
FIG. 23 is a perspective cross-sectional view of the knuckle.

As shown in FIGS. 17-20, the sprayer pivot assembly 107 is pivotally coupled to an outlet end of the spout 139 to allow the sprayer assembly 109 to rotate about dual axes (e.g., longitudinal axis, lateral axis) defined by the sprayer pivot assembly 107. The sprayer pivot assembly 107 includes a waterway 170 having a shouldered first end 171, which is coupled to the open outlet end of the spout 139 through threads, welding, or in another suitable manner, and a shouldered second end 172, which is received in a bore 177 of a base 176 of a knuckle 175. An internal fluid passage extends through the waterway 170 to fluidly connect the sprayer to the arm assembly 103. A fastener, such as a snap-ring 173 or other suitable element, can retain the second end 172 to the base 176. A collar 174 is disposed between an intermediate portion of the waterway 170 and the base 176 of the knuckle 175, where the collar 174 is configured to help retain a rotational position of the knuckle 175 relative to the spout 139. The waterway 170 and/or the collar 174 thereby defines a third pivot axis TPA about which the sprayer pivot assembly 107 can rotate relative to the waterway 170 and spout 139. As shown in FIG. 20, the collar 174 includes a plurality of longitudinally extending semi-circular flutes cut into an inner diameter of the collar 174, where each flute is configured to receive a longitudinal rib of the waterway 170 in a different relative rotational position. Alternatively, the collar 174 can include curved projections along the outer diameter, which engage mating recesses in the base 176. The knuckle 175 also includes an annular pivot sleeve 178 extending from the base 176. A lateral bore 179 extends through the pivot sleeve 178 defining a pivot axis, and a semi-circumferential slot 180 extending through a central portion of the pivot sleeve 178 forming two annular halves of the pivot sleeve 178. As shown in FIGS. 22 and 23, each half of the pivot sleeve 178 includes internal threads 181 in a raised shoulder.

Figure 21:
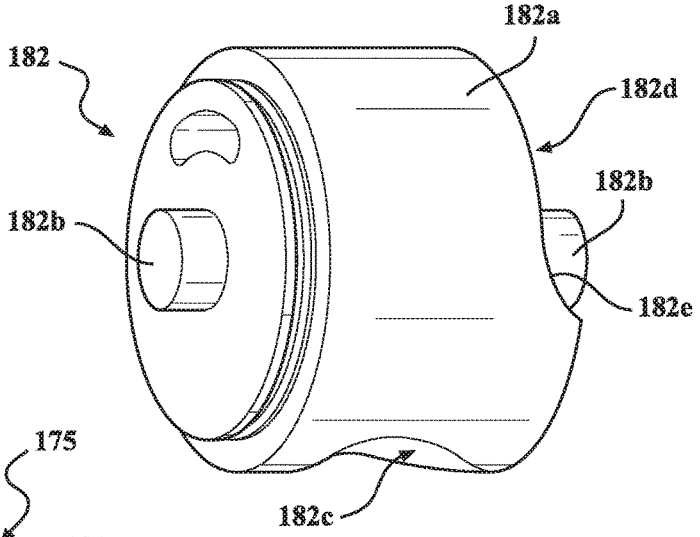
FIG. 21 is a perspective view of a pivot member of the sprayer pivot assembly.

As shown in FIG. 19, a pivot member 182 of the sprayer pivot assembly 107 is received in the pivot sleeve 178, such that the pivot member 182 can rotate about a fourth pivot axis PPA relative to the pivot sleeve 178. As shown in FIG. 21, the pivot member 182 has a cylindrical body **182*a* with two cylindrical pins 182*b* extending collinear from opposite sides of the body 182*a*. A radial bore 182*c* extends into the body 182*a* and is configured to receive a threaded end of the sprayer assembly 109. A semi-circumferential notch 182*d* on a side of the body 182*a* can receive a stop, such that ends 182*e* of the notch 182*d* define rotational stops of the stop to control the angle of rotation of the sprayer assembly 109**.

The sprayer pivot assembly 107 also includes a stop member 183, a first end member 184, and a second end member 185. As shown in FIG. 20, the stop member 183 includes an annular body **183*a* having a central opening 183*b* for receiving one pin 182*b* of the pivot member 182. A circular projection 183*c* extends from the body 183*a* and is configured to act as the stop to limit rotational travel of the pivot member 182. The first end member 184 includes an annular body 184*a* having threads 184*b* disposed around the outer surface of the body 184*a*, such that the first end member 184 screws to one set of the threads 181 of the pivot sleeve 178. As shown in FIGS. 19 and 20, the second end member 185 includes an annular body 185*a* having threads 185*b* disposed around the outer surface of the body 185*a*, such that the second end member 185 screws to the other set of the threads 181 of the pivot sleeve 178 during assembly. In this way, the first and second end members 184, 185 clamp the pivot member 182 and the stop member 183 between them in the bore 179 of the pivot sleeve 178. The illustrated second end member 185 includes a head 185*c* that extends radially outward from the body 185*a* to retain a seal, such as the O-ring 186, between the head 185*c* and the knuckle 175. Other O-rings 186 are optional, such as those shown in FIG. 19. Optionally, a cover 187 can be configured to attach (e.g., snap) to each of end member 184, 185. Optionally, a bearing 188 can be provided around one or both pins 182*b* of the pivot member 182 to improve relative rotation thereof relative to the first end member 184, the second end member 185, and/or the stop member 183**.

Figure 17:
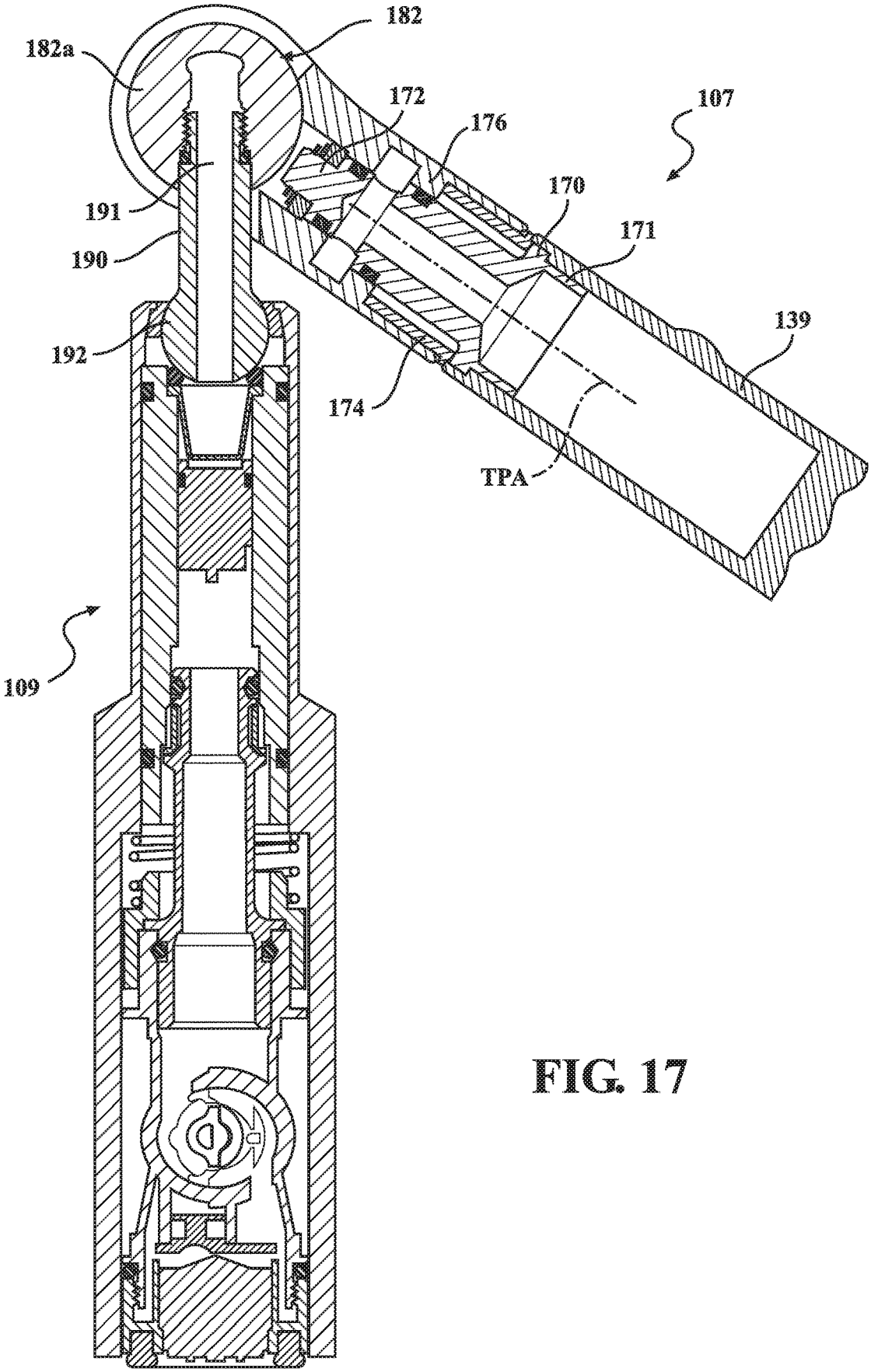
FIGS. 17-19 are cross-sectional views of a sprayer pivot assembly of the faucet.

As shown in FIGS. 17 and 18, the sprayer assembly 109 can be coupled to the pivot member 182 by screwing a shank 191 of a waterway 190 to internal threads in the bore **182*c*. Although the waterway 190 is shown having a ball or spherical joint, other types of waterways can couple the sprayer assembly 109 to the sprayer pivot assembly 107, namely the pivot member 182** thereof.

During operation of the faucet 100, the sprayer assembly 109 can be rotated with the pivot member 182 about its pivot axis relative to the knuckle 175 to move the sprayer forward and back (along an arc), the sprayer and sprayer pivot assembly 107 can be rotated about a (longitudinal) pivot axis relative to the spout 139 to move the sprayer side to side (along an arc), and the arm assembly 103 (along with the sprayer pivot assembly 107 and sprayer) can be pivoted about the first pivot axis FPA relative to the base assembly 101 to reposition the sprayer and the pivot axis between the sprayer and the sprayer pivot assembly 107. This multi-directional movement provides added utility to a user by allowing the sprayer to reach a greater area. Moreover, upon release of the sprayer, the biasing member 105 can be configured to gently return the sprayer to a "home" position.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the faucets as shown in the various exemplary embodiments is illustrative only. Additionally, any element disclosed in one embodiment may be incorporated or utilized with any other embodiment disclosed herein. For example, a pivot member, pivot assembly, etc. of an exemplary embodiment may be incorporated in other embodiments or in other locations within the embodiments. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A faucet comprising:

a base configured to mount to a support;

a riser having a first end, which couples to the base, and a distal second end;

a first pivot member extending between a first end and a second end, wherein the first pivot member operatively couples to the second end of the riser at a first pivot axis located between the first and second ends of the first pivot member;

a spout fluidly connected to the base through the riser and the first pivot member, the spout comprising an inlet end, which couples to the second end of the first pivot member such that the spout is rotatable relative to the riser through the first pivot member; and a biasing member operatively coupled to the first end of the first pivot member such that the biasing member creates a force, which biases and/or dampens relative rotation between the spout and the riser about the first pivot axis;

wherein the biasing member is a piston assembly comprising:

an outer body having a first end, which pivotally couples to a second pivot member defining a second pivot axis, and a second end; and an inner body having a first portion, which is received in the second end of the outer body, and a second portion, which extends outside of the outer body and pivotally couples to a third pivot member defining a third pivot axis, wherein the force is generated by a relative linear motion between the outer body and the inner body.

2. The faucet of claim 1, wherein the first end of the outer body includes a post, which threads to a collar of the second pivot member; and wherein the collar pivotally couples to a projection of the riser, which is located between the first and second ends of the riser, such that the outer body and the collar are rotatable relative to the riser.

3. The faucet of claim 1, wherein the second portion of the inner body extends into a lateral bore through a circumferential slot, each of the bore and the slot is defined by a pivot sleeve of the first pivot member, and the second portion includes a mounting hole that receives a fastener to pivotally couple the inner body to the pivot sleeve of the first pivot member through the third pivot member.

4. The faucet of claim 1, wherein the riser comprises:

an elbow proximate the second end of the riser, such that the second end of the riser is at an angle relative to the first end of the riser; and a projection extending transversely from and proximate to the first end of the riser, wherein a first end of the biasing member pivotally couples to the projection, such that the biasing member is rotatable relative to the riser.

5. The faucet of claim 4, wherein the projection extends in a first radial direction relative to a longitudinal axis of the riser, and the second end of the riser extends in a second radial direction, which is parallel to the first radial direction.

6. The faucet of claim 1, wherein the base comprises:

an annular plate;

a flange that extending downwardly from an outer periphery of the annular plate; and an annular shoulder extending upwardly from an inner periphery of the annular plate, wherein the shoulder couples directly to the first end of the riser.

7. The faucet of claim 6, further comprising:

a collar housed under the base;

a sleeve that threads to the collar;

a waterway disposed within the sleeve and configured to direct water into the riser through the base; and a bearing interposed between the waterway and the sleeve to allow relative rotation therebetween.

8. A faucet comprising:

a base configured to mount to a support;

a riser having a first end, which couples to the base, and a distal second end;

a first pivot member extending between a first end and a second end, wherein the first pivot member operatively couples to the second end of the riser at a first pivot axis located between the first and second ends of the first pivot member;

a spout fluidly connected to the base through the riser and the first pivot member, the spout comprising an inlet end, which couples to the second end of the first pivot member such that the spout is rotatable relative to the riser through the first pivot member;

a biasing member operatively coupled to the first end of the first pivot member such that the biasing member creates a force, which biases and/or dampens relative rotation between the spout and the riser about the first pivot axis; and a sprayer assembly coupled to an outlet end of the spout, wherein the sprayer assembly includes a sprayer that is rotatable relative to the spout about a longitudinal axis of the spout.

9. The faucet of claim 8, further comprising a sprayer pivot assembly having a pivot member, which defines a second pivot axis that is transverse to the longitudinal axis, such that the sprayer is rotatable relative to the spout about each of the second pivot axis and the longitudinal axis.

10. The faucet of claim 8, wherein the first pivot member includes a projection extending laterally from a side at a location between the first and second ends of the first pivot member, the projection defines the first pivot axis, and the second end of the first pivot member includes an annular pivot sleeve having a lateral bore and a circumferential slot receiving an end of the biasing member.

11. The faucet of claim 8, wherein the riser comprises:

an elbow proximate the second end of the riser, such that the second end of the riser is at an angle relative to the first end of the riser; and a projection extending transversely from and proximate to the first end of the riser, wherein a first end of the biasing member pivotally couples to the projection, such that the biasing member is rotatable relative to the riser.

12. A faucet, comprising:

a riser having a first end and a distal second end;

a first pivot member extending between a first end and a second end, wherein the first pivot member operatively couples to the second end of the riser at a first pivot axis located between the first and second ends of the first pivot member;

a spout having an inlet end, which couples to the second end of the first pivot member to fluidly connect the spout to the riser through the first pivot member;

a second pivot member defines a second pivot axis and is operatively coupled to a portion of the riser located between the first and second ends thereof; and a third pivot member defines a third pivot axis and is operatively coupled to the first end of the first pivot member;

a biasing member pivotally coupled to each of the second and third pivot members about the second and third pivot axes, respectively, such that the biasing member creates a force, which biases and/or dampens relative rotation between the spout and the riser about the first pivot axis.

13. The faucet of claim 12, wherein the biasing member comprises:

an outer body pivotally coupled to the second pivot member, such that the outer body is rotatable about the second pivot axis; and an inner body having a first portion, which is received in the outer body, and a second portion, which extends outside of the outer body and pivotally couples to the third pivot member, such that the second portion is rotatable about the third pivot axis.

14. The faucet of claim 13, wherein the second pivot member comprises a collar rotatably coupled to a projection of the riser, the outer body includes a post that threads to the collar such that the outer body and the collar are rotatable relative to the riser, and the projection is located proximate the first end of the riser.

15. The faucet of claim 14, wherein the second pivot member comprises:

a plug coupled directly to the projection;

a fastener extending through a bore of the collar and threading to the plug to rotatably couple the collar to the plug and riser; and at least one bearing disposed between the fastener and the collar.

16. The faucet of claim 13, wherein the third pivot member comprises a male fastener disposed in a lateral bore of the first pivot member and engaging a mounting hole in the second portion of the inner body to rotatably couple the inner body to the first pivot member through the third pivot member, and wherein the second portion of the inner body extends into the lateral bore through a slot in a pivot sleeve of the first pivot member.

17. The faucet of claim 16, wherein the third pivot member comprises:

a female fastener disposed in the lateral bore of the first pivot member and coupled to the male fastener to secure the second portion of the inner body between the female fastener and a head of the male fastener; and at least one bearing located between the second portion of the inner body and at least one of the male fastener or the female fastener.

18. A faucet, comprising:

a riser having upper and lower ends;

a first pivot member having a body, which extends between first and second ends, and a projection, which is located between the first and second ends and which pivotally couples the first pivot member to the upper end of the riser;

a spout coupled to the second end of the first pivot member to fluidly connect the spout to the riser through the first pivot member;

a second pivot member operatively coupled to a portion of the riser located between the upper and lower ends; and a third pivot member operatively coupled to the first pivot member;

a biasing member comprising:

a first portion pivotally coupled to the second pivot member; and a second portion operatively coupled to the first portion and pivotally coupled to the third pivot member, wherein the biasing member creates a force, which biases and/or dampens relative rotation between the spout and the riser.

19. The faucet of claim 18, wherein the first portion is an outer body having a first end, which pivotally couples to the second pivot member, and a second end; and wherein the second portion is an inner body having a first end, which is received in the second end of the outer body, and a second end, which extends outside of the outer body and pivotally couples to the third pivot member.

20. The faucet of claim 19, wherein the inner body is slidably sealed to the outer body with an internal biasing system located within an internal portion of the biasing member that is sealed by the inner and outer portions, and wherein the force is generated by a relative linear motion between the outer body and the inner body.

* * * * *